US006131221A

United States Patent [19]

Yang

[11] Patent Number: 6,131,221

[45] Date of Patent: Oct. 17, 2000

[54] CUSHION PAD

[76] Inventor: Shi-Hong Yang, 58, Ma Yuan West St., Taichung, Taiwan

[21] Appl. No.: 09/058,748

[22] Filed: Apr. 10, 1998

[51] Int. Cl.[7] ..... A47C 20/02

[52] U.S. Cl. ..... 5/653; 297/452.48; 442/44; 442/45; 36/44; 5/939; 5/952

[58] Field of Search ..... 297/452.48; 5/652, 5/653, 939, 952; 442/44, 45, 48, 36, 35; 36/43, 44

[56] References Cited

U.S. PATENT DOCUMENTS 3,638,255 2/1972 Sterrett ..... 5/653
4,250,172 2/1981 Mutzenberg et al. ..... 442/44
4,743,495 5/1988 Lilani et al. ..... 442/36
5,139,841 8/1992 Makoui et al. ..... 442/35
5,691,036 11/1997 Lin et al. ..... 442/36

*Primary Examiner*—Anthony D. Barfield

[57] ABSTRACT

A cushion pad has an upper layer, a middle layer, and a lower layer. The middle layer is disposed between the lower layer and the upper layer. The upper layer is made of an air-permeability fabric. The middle layer has two mixture layers, and a gauze fabric layer disposed between the mixture layers. The lower layer is made of a water-absorbing non-woven fabric.

3 Claims, 2 Drawing Sheets

CUSHION PAD

BACKGROUND OF THE INVENTION

The present invention relates to a cushion pad. More particularly, the present invention relates to a cushion pad which has an air-permeability function and a water-absorbing function.

A conventional cushion pad can be used as a matress, a chair cushion, a sofa cushion, and a pad for many articles. The user can sit or lie on the conventional cushion pad. However, the conventional cushion pad does not have any good air-permeability function nor good water-absorbing function.

SUMMARY OF THE INVENTION

An object of the present invention is to provide a cushion pad which has an air-permeability function and a water-absorbing function.

Another object of the present invention is to provide a cushion pad which has an antibacterial function to inhibit the growth of the bacteria.

Yet another object of the present invention is to provide a cushion pad which has a deodorizing function.

Accordingly, a cushion pad comprises an upper layer, a middle layer, and a lower layer. The middle layer is disposed between the lower layer and the upper layer. The upper layer is made of an air-permeability fabric. The middle layer has two mixture layers, and a gauze fabric layer disposed between the mixture layers. The lower layer is made of a water-absorbing non-woven fabric.

DETAILED DESCRIPTION OF THE INVENTION

Figure 1:
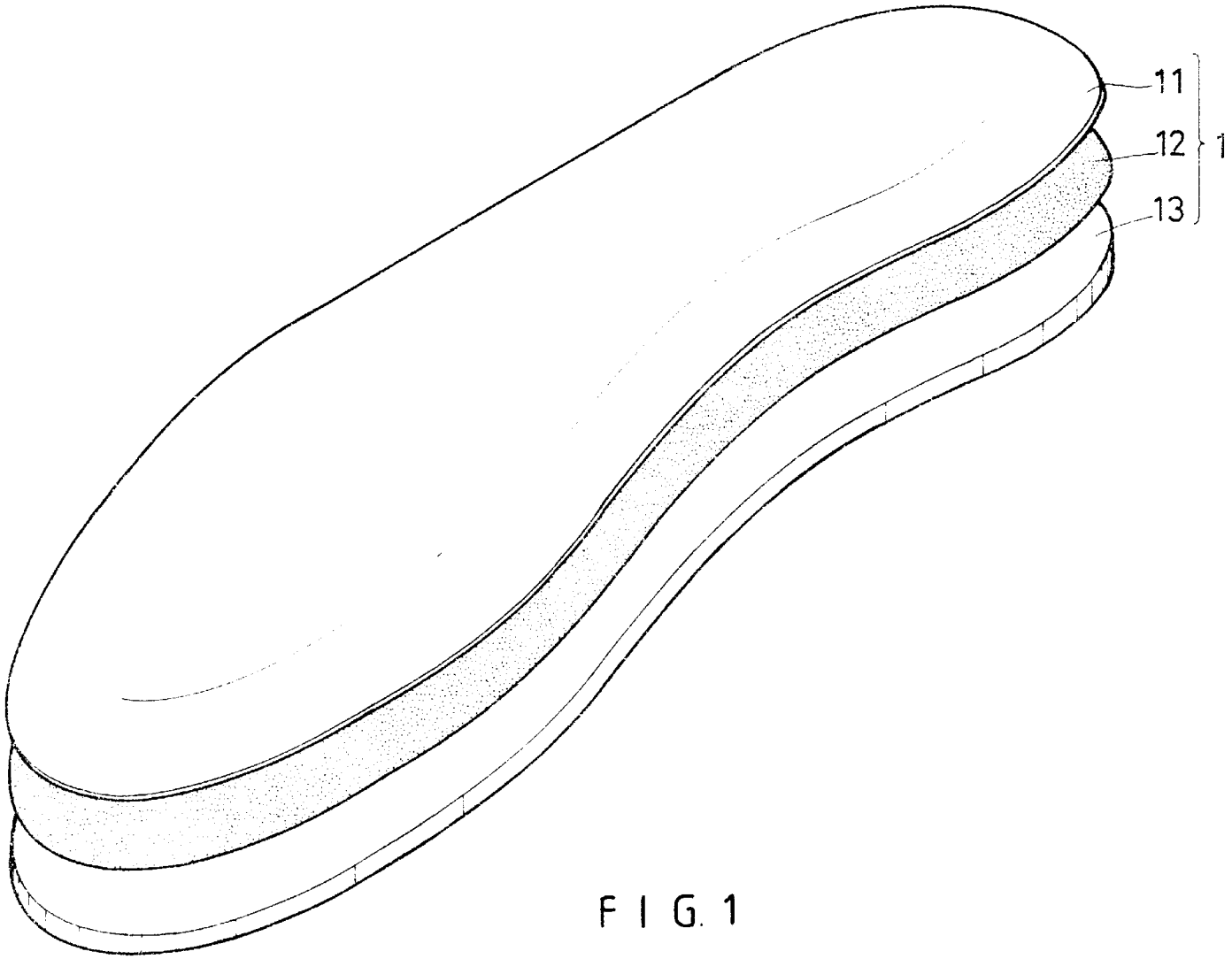
FIG. 1 is a perspective exploded view of a cushion pad of a preferred embodiment in accordance with the present invention.
Figure 3:
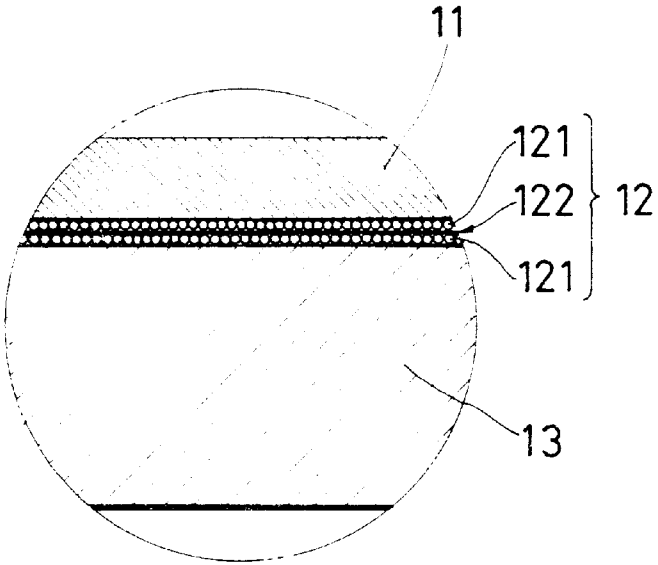
FIG. 3 is a partially enlarged view of FIG. 2.
Figure 2:
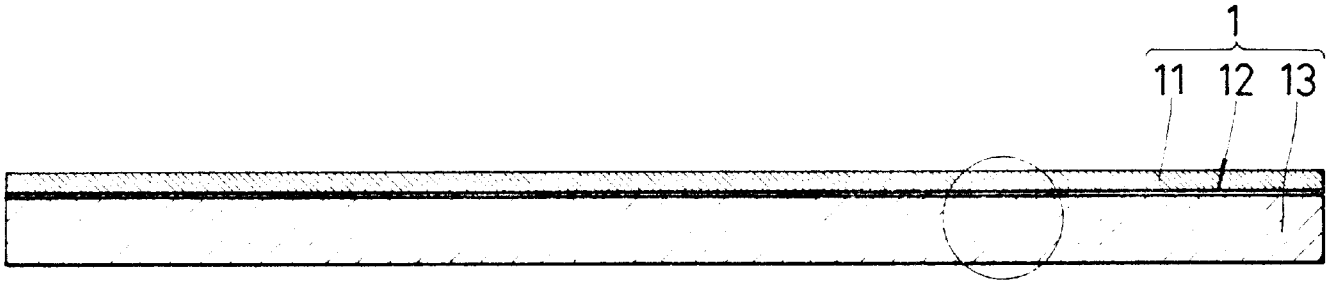
FIG. 2 is a sectional assembly view of a cushion pad of a preferred embodiment in accordance with the present invention.

Referring to FIGS. 1 to 3, a cushion pad 1 comprises an upper layer 11, a middle layer 12, and a lower layer 13. The middle layer 12 is disposed between the lower layer 13 and the upper layer 11.

The upper layer 11 is made of an air-permeability fabric. Therefore, the upper layer 11 has a good air-permeability function.

The middle layer 12 has two mixture layers 121, and a gauze fabric layer 122 disposed between the mixture layers 121. Each mixture layer 121 is made of an activated carbon, an alum, a ceramic powder, a resin, and an antibacterial agent. Each mixture layer 121 is applied or coated on the gauze fabric layer 122. After the middle layer 12 is dried, the middle layer 12 can be disposed between the lower layer 13 and the upper layer 11. The ceramic powder can inhibit the growth of the bacteria. The ceramic powder has a deodorizing function. The alum has a deodorizing function.

The lower layer 13 is made of a water-absorbing non-woven fabric. Therefore, the lower layer 13 has a good water-absorbing function. The non-woven fabric can be made of a polyester material or a polyethylene terephthalate (PET) material.

The present invention is not limited to the above embodiment but various modification thereof may be made. Furthermore, various changes in form and detail may be made without departing from the scope of the present invention.

I claim:

1. A cushion pad comprising:

an upper layer, a middle layer, and a lower layer, the middle layer disposed between the lower layer and the upper layer, the upper layer made of an air-permeability fabric, the middle layer having two mixture layers, and a gauze fabric layer disposed between the mixture layers, the lower layer made of a water-absorbing non-woven fabric, and each said mixture layer made of an activated carbon, an alum, a ceramic powder, a resin, and an antibacterial agent.

2. The cushion pad as claimed in claim 1, wherein said water-absorbing non-woven fabric is made of a polyester material.

3. The cushion pad as claimed in claim 1, wherein said water-absorbing non-woven fabric is made of a polyethylene terephthalate material.

* * * * *